US011646192B1

(12) United States Patent
Boroughf

(10) Patent No.: US 11,646,192 B1
(45) Date of Patent: May 9, 2023

(54) LIGHT BULB CHANGER

(71) Applicant: William Boroughf, Cape Coral, FL (US)

(72) Inventor: William Boroughf, Cape Coral, FL (US)

( * ) Notice: Subject to any disclaimer, the term of this patent is extended or adjusted under 35 U.S.C. 154(b) by 0 days.

(21) Appl. No.: 17/974,916

(22) Filed: Oct. 27, 2022

(51) Int. Cl.
*H01K 3/32* (2006.01)
*B25B 9/00* (2006.01)
*B25B 13/48* (2006.01)

(52) U.S. Cl.
CPC ..... *H01K 3/32* (2013.01); *B25B 9/00* (2013.01); *B25B 13/481* (2013.01)

(58) Field of Classification Search
CPC ..... H01K 3/32; B25B 9/00; B25B 13/481
USPC ..... 81/53.11
See application file for complete search history.

(56) References Cited

U.S. PATENT DOCUMENTS

2004/0025641 A1* 2/2004 Sugano ..... H01K 3/32 81/53.11
2012/0125161 A1* 5/2012 Ellis ..... H01K 3/32 81/53.12
2015/0013501 A1* 1/2015 Johnson ..... H01K 3/32 81/53.12

* cited by examiner

*Primary Examiner* — Hadi Shakeri
*Assistant Examiner* — Aaron R McConnell
(74) *Attorney, Agent, or Firm* — MaxGoLaw PLLC

(57) ABSTRACT

A light bulb changer including an elongated pole having a first configured to be rotated about a longitudinal axis thereof, a support structure engaged with the elongated pole near a second end of the elongated pole, and a bulb holder extending from a second end of the support structure. A pair of cog belt pullies and a belt positioned therebetween transfer the rotation of the elongated pole about tis longitudinal axis to rotation of the bulb holder about a central axis thereof that is spaced apart from the longitudinal axis of the elongate pole. The bulb changer enabling removal and replacement of light bulbs of overhead light fixtures with a user safely positioned on a floor under the light fixture with a clear line of sight of the bulb and without the need for ladders or other elevations.

16 Claims, 4 Drawing Sheets

LIGHT BULB CHANGER

FIELD OF THE INVENTION

The present invention relates to a remote access tool. More specifically, the present invention relates to a light bulb changer designed to remove and replace light bulbs of various sizes, shapes, and configurations which are held at a variety of angles and heights and are otherwise inaccessible from ground level.

BACKGROUND OF THE INVENTION

Overhead lights are very common lighting fixtures in both residential and commercial settings. Such lights are positioned overhead to provide sufficient light within a room from an angle that enhances visibility within the lighted room. Overhead lights additionally help to minimize risks associated with heat burns and unintentional contact which could result in globe glass breakage given that such fixtures are typically out of reach of someone standing on the floor of a room. Examples of such overhead lights include chandeliers and recessed lighting such as can lights.

While the lighting fixtures are advantageous in that they are positioned overhead and out of reach from a person standing on the floor of a room, replacing the lightbulbs of such lights can be a challenge and can even result in bodily injury. That is, because of the height at which many overhead lighting fixtures are positioned, accessing the lightbulbs thereof for replacement requires the use of a ladder or other set up to raise a person to an elevated position from which the overhead bulb may be reached. Such elevated positions can lead to dangerous falls that cause bodily injury. Furthermore, the light bulbs of such lighting fixtures may be recessed within their fixtures, limiting physical access to only a small portion of the bulb, making accessing such bulbs for replacement difficult.

Devices have been contemplated in the past that attempt to aid in light bulb replacement for overhead fixtures, however, such devices often still require a user being at an elevated position on a ladder, stair, or landing, or require the user to work off his or her longitudinal anatomical axis, which can lead to imbalance and falls or strains. Additionally, the off-axis use of such existing devices impairs the user's ability to see the light bulb they are attempting to change, given that such off-axis positions interfere with the line of sight of the target bulb, which can lead to broken bulbs and damage to the light fixture. Another problem stems from the variety of angles from which bulbs must be extracted and replaced from these remote locations, such as from chandeliers and hanging light arrangements. Existing bulb replacement tools are typically provided at a fixed angle and therefore not able to accommodate bulbs positioned at a variety of angles. Another problem associated with existing bulb replacement devices, is that such devices are not able to accommodate bulbs of various sizes, thus requiring a separate tool for different bulb shapes and sizes. Other problems arise from the need to apply force to the bulb and lighting fixture: too much force can cause damage to the bulb or fixture, or even bodily injury.

Thus, there exists a need for a light bulb changer designed to facilitate removal and replacement of light bulbs of various sizes, shapes, and configurations which are held at a variety of angles and heights and are otherwise inaccessible from ground level. There further exists a need for such a device that is designed to be used without a ladder or need of some elevated platform such as a landing on stairway and allows a user to be positioned directly under the overhead fixture thus enabling full line of sight.

SUMMARY OF THE INVENTION

The present invention provides a light bulb changer that includes an elongated pole having a first configured to be rotated about a longitudinal axis thereof, a support structure engaged with the elongated pole near a second end of the elongated pole, and a bulb holder extending from a second end of the support structure. A pair of cog belt pullies and a belt positioned therebetween transfer the rotation of the elongated pole about tis longitudinal axis to rotation of the bulb holder about a central axis thereof that is spaced apart from the longitudinal axis of the elongate pole. The bulb changer enabling removal and replacement of light bulbs of overhead light fixtures with a user safely positioned on a floor under the light fixture with a clear line of sight of the bulb and without the need for ladders or other elevations.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

Figure 1:
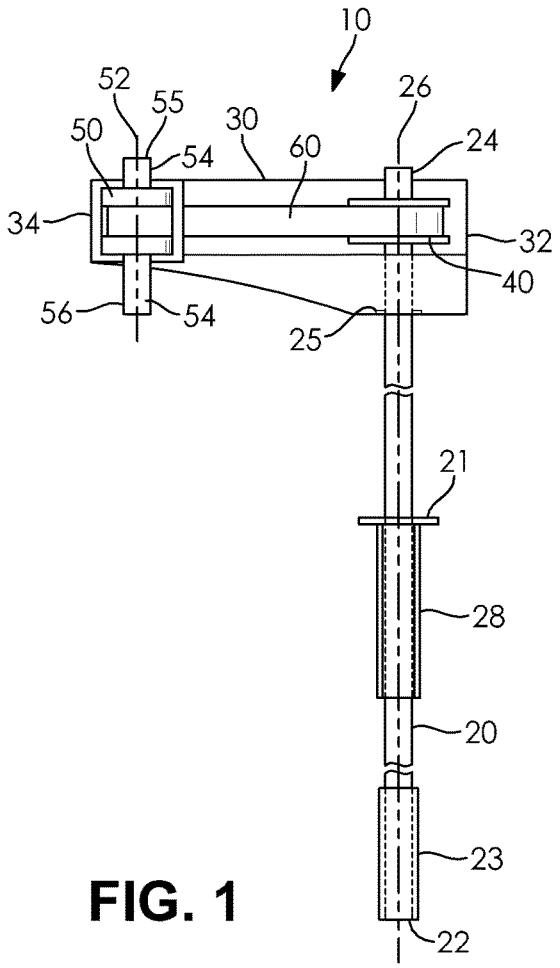
FIG. 1 is a side view of a light bulb changer without a bulb holder attached according to embodiments of the present invention.
Figure 2A:
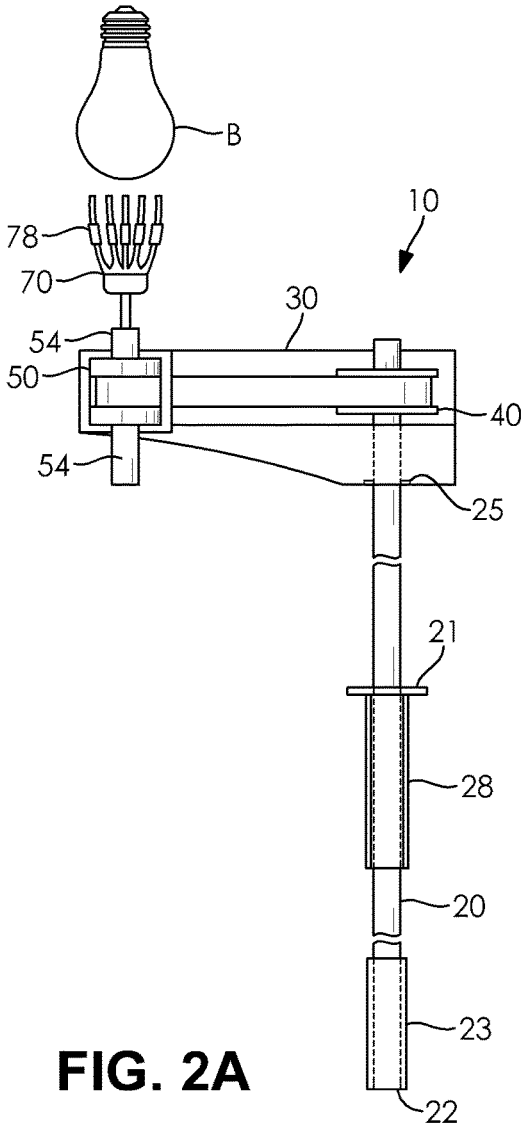
FIG. 2A is a side view of a light bulb changer with a bulb holder attached at an upper side of the housing according to embodiments of the present invention.
Figure 2B:
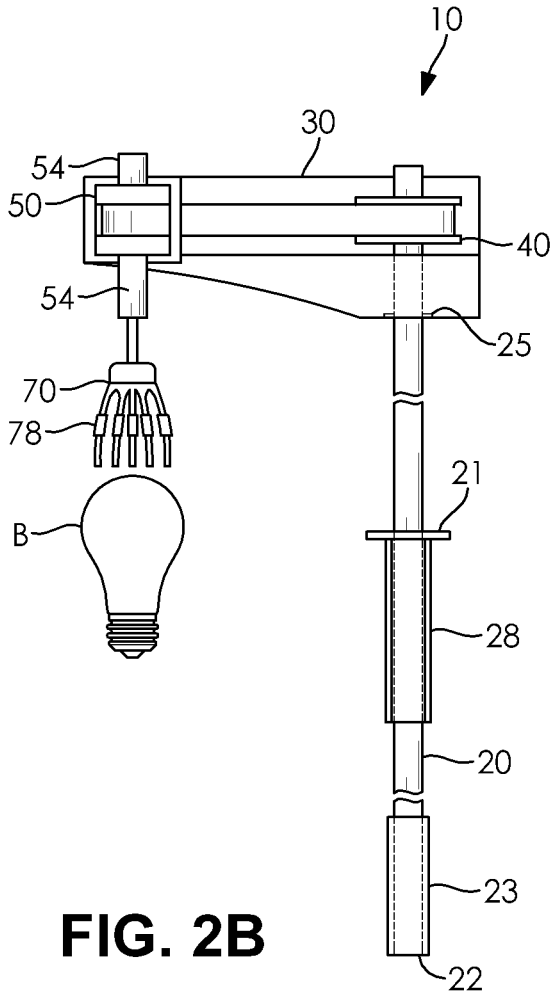
FIG. 2B is a side view of a light bulb changer with a bulb holder attached at a lower side of the housing according to embodiments of the present invention.

The present invention has utility as a light bulb changer to facilitate removal and replacement of light bulbs of various sizes, shapes, and configurations which are held at a variety of angles and heights and are otherwise inaccessible from ground level. The inventive light bulb changer is configured for use without a ladder or need for some elevated platform such as a landing on stairway and allows a user to be positioned directly under the overhead fixture thus enabling full line of sight.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention.

Unless indicated otherwise, explicitly or by context, the following terms are used herein as set forth below.

As used in the description of the invention and the appended claims, the singular forms "a," "an" and "the" are intended to include the plural forms as well, unless the context clearly indicates otherwise.

Also as used herein, "and/or" refers to and encompasses any and all possible combinations of one or more of the associated listed items, as well as the lack of combinations when interpreted in the alternative ("or").

According to embodiments, an inventive light bulb changer 10 includes an elongated pole 20 having a first end 22, a second end 24, and a longitudinal axis 26. The elongated pole 20 is configured to be rotated about the longitudinal axis 26 thereof. The light bulb changer 10 additionally includes a support structure 30 having a first end 32 and a second end 34. The first end 32 of the support structure 30 is engaged with the elongated pole 20 near the second end 24 of the elongated pole 20. The light bulb changer 10 additionally includes a pair of cog belt pullies 40, 50 and a belt 60 spanning therebetween. A first cog belt pully 40 is coupled to the elongated pole 20 near the second end 24 of the elongated pole 20. The first cog belt pully 40 is coaxial with the longitudinal axis 26 of the elongated pole 20 and is configured to rotate with the elongated pole 20 as the elongated pole 20 is rotated about its longitudinal axis 26. Notably, the elongated pole 20 and the first cog belt pully 40 rotate about the longitudinal axis 26 independently of the support structure 30. That is, while the support structure 30 is engaged with the elongated pole 20, the support structure 30 does not rotate with the elongated pole 20 about the longitudinal axis 26 of the elongated pole 20. The second cog belt pully 50 is coupled to the second end 34 of the support structure 30. The second cog belt pully 50 has a central axis 52 that is spaced apart from the longitudinal axis 26 of the elongated pole 20. The belt 60 spans between the first cog belt pully 40 and the second cog belt pully 50. The belt 60 is configured to cause the second cog belt pully 50 to rotate around its central axis 52 based on the rotation of the first cog belt pully 40, which rotates with the elongated pole 20. The light bulb changer 10 additionally includes a bulb holder 70 that is configured to couple to the second cog belt pully 50 to rotate therewith. The bulb holder 70 is further configured to securely hold a light bulb of any of a multitude of sizes and shapes to screw and unscrew the light bulb into an overhead light fixture.

The elongated pole 20 is configured to be held in the hands of a user and rotated about the longitudinal axis 26 by the hands of the user. Other methods for rotating the elongated pole 20 are also contemplated, including a motor. In order to facilitate a comfortable hold of the elongated pole 20, the elongated pole 20 is provided having an outer diameter of no more than two inches. According to embodiments, the pole 20 has a constant outer diameter along its entire length, while according to further embodiments, the outer diameter of the pole 20 changes along its length, for example narrowing toward the second end 24. According to some inventive embodiments, the elongated pole is formed of metal, plastic, or a composite material such as carbon fiber. According to some inventive embodiments, the elongated pole 20 is hollow. According to embodiments, the elongated pole 20 has a length from the first end 22 to the second end 24 that is at least 4 feet long and may be as long as 20 feet long. According to embodiments, the elongated pole 20 has a length that is adjustable. For example, the elongated pole 20 is configured to telescope or collapse upon itself. In such telescoping embodiments, the pole 20 includes a locking mechanism to fix the length of the pole 20 at an adjusted telescoped length. According to other embodiments, the length of the pole 20 is adjusted by joining separate portions of the pole 20 together to create a pole 20 of a desired length. According to some inventive embodiments, the elongated pole 20 additionally includes a grip 23 provided at the first end 22 of the elongated pole 20. The grip 23 provides a hand hold for a user's hand that will rotate the elongated pole 20 about its longitudinal axis 26. The grip 23 provides a comfortable hold of the elongated pole 20, an indicator to the user as to where the pole 20 should be held for best rotations thereof, and an enhanced non-slip grip of the pole 20.

According to some inventive embodiments, the inventive light bulb changer 10 additionally includes a handle 28 that is engaged with the elongated pole 20. The handle 28 is disposed near the first end 22 of the elongated pole 20, above the grip 23. The handle 28 is configured to provide a place for a user to hold in order to stabilize the pole 20 with one hand while the user's other hand works to rotate the elongated pole 20, which may be positioned at the grip 23 when provided. According to some inventive embodiments, the handle 28 defines a through hole through which the elongated pole 20 passes, thereby allowing the elongated pole 20 to rotate about its longitudinal axis 26 within the handle 28. The through hole of the handle 28 thus has a central axis that is coaxial with the longitudinal axis 26 of the elongated pole 20. As shown in FIG. 1, the handle is a hollow cylinder sleeve around the pole 20. According to some inventive embodiments, the handle 28 abuts a collar 21 that is disposed on the elongated pole 20 in order to fix the position of the handle 28 along the length of the pole 20. According to some incentive embodiments, the collar 21 is friction fit with the pole 20 or integrally formed with the pole 20. According to some inventive embodiments, the position of the collar 21 along the length of the pole 20 is adjustable.

As noted above, the light bulb changer 10 additionally includes a support structure 30 having a first end 32 and a second end 34. The first end 32 of the support structure 30 is engaged with the elongated pole 20 near the second end 24 of the elongated pole 20. Notably, the support structure 30 is engaged with the elongated pole 20 in such a way as to not interfere with the rotation of the elongated pole 20 about its longitudinal axis 26. For example, the support structure 30 may define a hole into which the second end 24 of the elongated pole 20 is inserted for rotation therein. According to some inventive embodiments, the hole in the support structure 30 is a bracket connected to the support structure 30. The hole is provided near the first end 32 of the support structure 30. According to some inventive embodiments, a collar 25 is provided on the elongated pole 20 to fix the position of the support structure 30 with the elongated pole 20. According to some inventive embodiments, the support structure 30 is a housing, is made of metal, plastic, or composite material. According to embodiments, the support structure 30 encloses the first cog belt pully 40, the second cog belt pully 50, and the belt 60 to protect the mechanical workings of the device 10 safe from interference, dirt, and debris, and also to prevent a user's fingers from getting pinched by the pullies 40, 50 and belt 60. As shown in FIG. 1, the support structure 30 extends perpendicularly from the elongated pole 20. The support structure has a length from the first end 32 to the second end 34. According to embodiments, the length of the support structure 30 is at least 6 inches and up to 24 inches.

Figure 3:
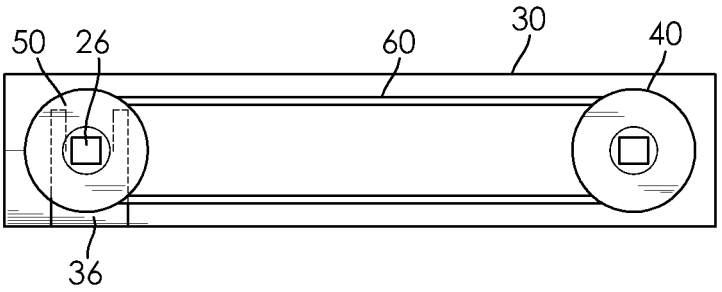
FIG. 3 is a top view of a light bulb changer according to embodiments of the present invention.

As noted above, the second cog belt pully 50 is coupled to the second end 34 of the support structure 30. The central axis 52 of the second cog belt pully 50 is spaced apart from the longitudinal axis 26 of the elongated pole 20. The belt 60 spans between the first cog belt pully 40 and the second cog belt pully 50. The belt 60 is configured to cause the second cog belt pully 50 to rotate around its central axis 52 based on the rotation of the first cog belt pully 40, which rotates with the elongated pole 20. To achieve this, the belt 60 is held in slight tension between the cog belt pullies 40, 50. According to some inventive embodiments, the second cog belt pully 50 is coupled to the second end 34 of the support structure 30 by way of a bracket 36, such as that shown in FIG. 3. According to embodiments, the bracket 36 is C-shaped. The bracket 36 thus fixes the second cog belt pully 50 to the second end 34 of the support structure 30 while still allowing the second cog belt pully 50 to rotate about its central axis 52. According to some inventive embodiments, the central axis 52 of the second cog belt pully 50 is parallel to the longitudinal axis 26 of the elongated pole 20, however, other arrangements are also contemplated.

As noted above, the light bulb changer 10 additionally includes a bulb holder 70 that is configured to couple to the second cog belt pully 50 to rotate therewith. The bulb holder 70 is further configured to securely hold a light bulb B of any of a multitude of sizes and shapes to screw and unscrew the light bulb into an overhead light fixture F. According to some inventive embodiments, the bulb holder 70 includes a plurality of spring-loaded fingers 72. The spring-loaded fingers 72 are joined at a base 74 of the bulb holder 70 with the opposite ends of 75 the fingers 72 defining an opening 76 of the bulb holder 70. The ends 75 of the fingers 72 are biased to a closed position and movable to an open position around the opening 76, so that the diameter of the opening 76 is expandable to accommodate light bulbs B of various sizes and shapes. It will be understood that as the ends 75 of the fingers 72 contact a bulb B, the ends 75 of the fingers with expand to conform with the surface of the bulb B, thereby allowing the opening 76 to expand as the shape of the bulb B expands. Then as the shape of the bulb tapers, the ends 75 of the fingers 72 return to the closed position of the bulb holder 70. According to some inventive embodiments, the spring-loaded fingers 72 each has a friction elements 78 positioned thereon to grip the bulb B and prevent the bulb B from rotating within the bulb holder 70. Accordingly, the bulb B when held within the finger 72 of the bulb holder 70 is secure and prevented from rotating within the bulb holder 70, and instead rotating with the bulb holder 70 as it rotates with the second cog belt pully 50.

According to some inventive embodiments, the bulb holder 70 is configured to releasably couple to the second cog belt pully 50 to rotate therewith. According to embodiments, the bulb holder 70 releasably couples to the second cog belt pully 50 via a rod 54 that is either provided on bulb holder 70 or on the second cog belt pully 50. The rod 54 may attach to the bulb holder 70 via friction fit or threaded interaction. As shown in FIG. 1, the rod 54 is provided as an extension from the second cog belt pully 50. According to some inventive embodiments, the rod 54 has two opposing ends that extend from the second cog belt pully 50, namely a first end 55 that points in the direction opposite the pole 20 and a second end 56 that points in a direction on the same side as the pole 20. Accordingly, the bulb holder 70 is configured to be coupled to the second cog belt pully 50 so that the opening 76 of the bulb holder 70 is configured to be positioned on a side of the support structure 30 opposite the elongated handle 20 and alternatively so that the opening 76 of the bulb holder 70 is configured to be positioned on a side of the support structure 30 with the elongated handle 20.

Figure 4A:
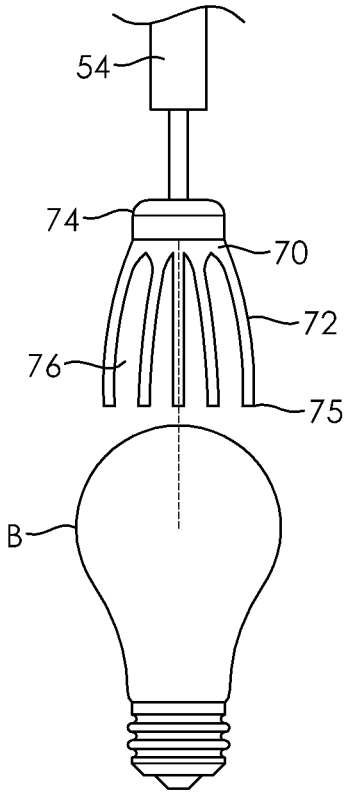
FIGS. 4A-4C show a progression of a bulb holder of the light bulb changer as it is aligned with, engaged with, and securely holding a light bulb according to embodiments of the present invention.
Figure 4B:
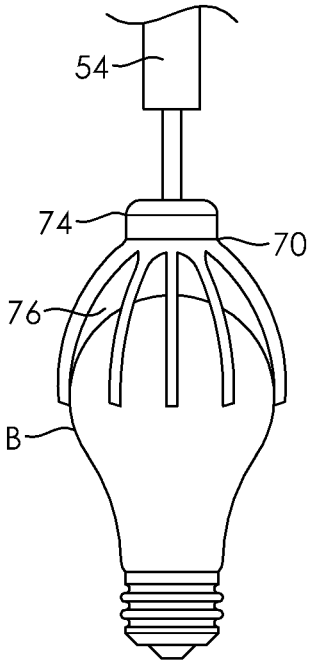
Figure 4C:
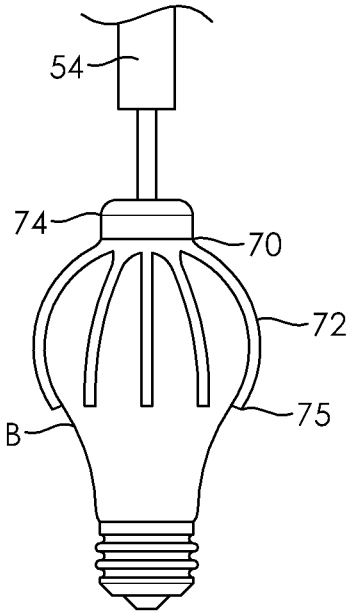
Figure 5A:
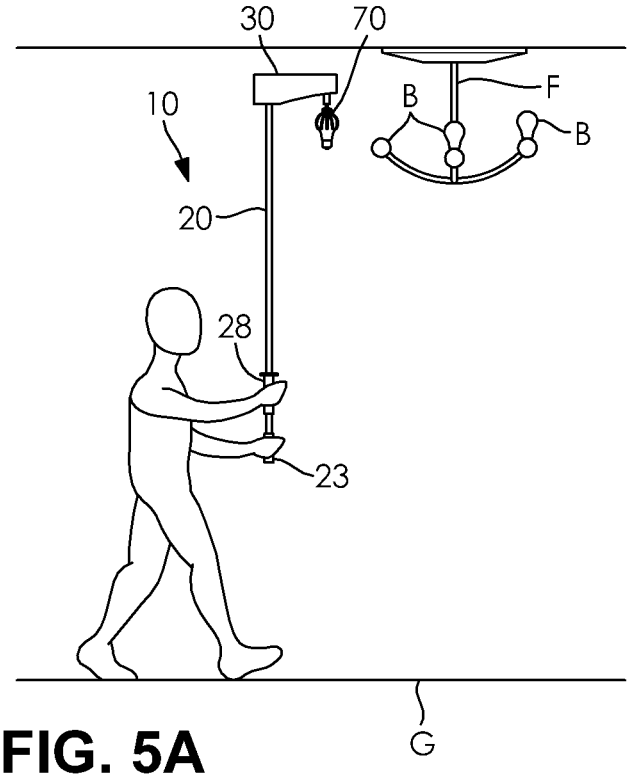
FIG. 5A is a side view of a user using an inventive light bulb changer to change an upward facing light bulb of a light fixture according to embodiments of the present invention.
Figure 5B:
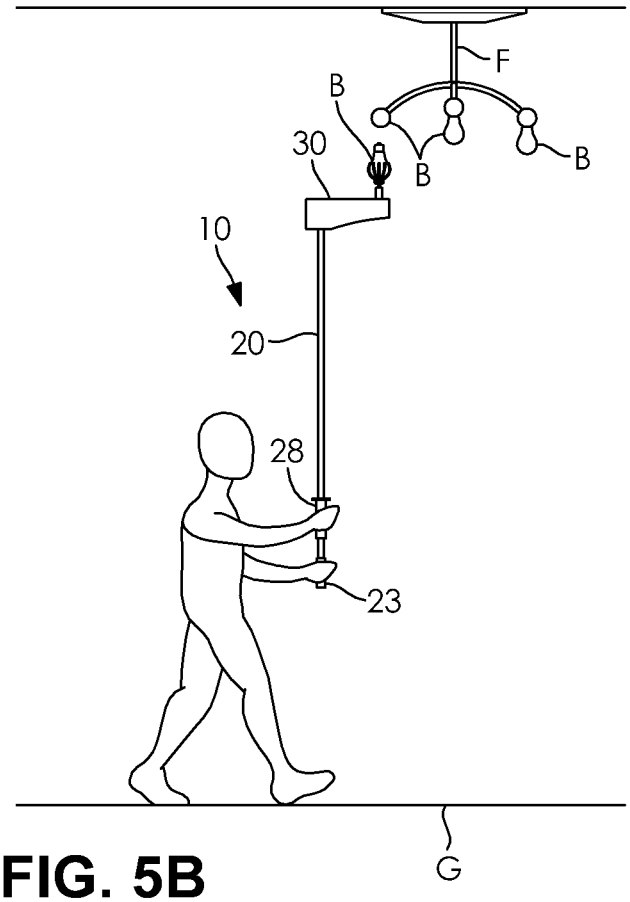
FIG. 5B is a side view of a user using an inventive light bulb changer to change a downward facing light bulb of a light fixture according to embodiments of the present invention.

As shown in FIGS. 5A and 5B, the inventive light bulb changer device 10 is used to remove and replace light bulbs B of various sizes, shapes, and configurations which are held in fixtures F at a variety of angles and heights and are otherwise inaccessible from ground level G. The inventive light bulb changer 10 is configured for use without a ladder or need for some elevated platform such as a landing on stairway and allows a user to be positioned directly on the ground G or floor under the overhead fixture F thus enabling full line of sight. A method of using the inventive light bulb changer 10 includes a user adjusting the length of the elongated pole 20 to a length that allows the bulb holder 70 to access the target bulb B within a target light fixture F. Then, the user attaches the bulb holder 70 to the second cog belt pully 50 based on the orientation of the target light bulb B. That is, if the target light bulb B is held in the light fixture F with the screw thread contact of the bulb B closest to the floor so that the glass portion of the bulb B points to the ceiling, the user will couple the bulb holder 70 to the second end 56 of the rod 54 so that the opening 76 of the bulb holder 70 is positioned on a side of the support structure 30 with the elongated pole 20 so the opening 76 of the bulb holder 70 may come in contact with the glass of the bulb B. In contrast, if the target light bulb B is held in the light fixture F with the screw thread contact of the bulb B farthest from the floor so that the glass portion of the bulb B points to the floor, the user will couple the bulb holder 70 to the first end 55 of the rod 54 so that the opening 76 of the bulb holder 70 is positioned on a side of the support structure 30 that is opposite the elongated pole 20 so the opening 76 of the bulb holder 70 may come in contact with the glass of the bulb B. Once the bulb holder 70 has been attached to the second cog belt pully 50, the user holds the elongated pole 20 to bring the bulb holder 70 into contact with the bulb B within the light fixture F. That is, the user aligns the opening 76 of the spring-loaded fingers 72 with the glass portion of the bulb B, as shown in FIG. 4A, and applies a slight pressure thereto, which causes the spring-loaded fingers 72 to open around the shape of the bulb B, as shown in FIG. 4B. Once the bulb B is securely within the bulb holder 70, as shown in FIG. 4C, the user then rotates the elongated pole 20 about its longitudinal axis 26. The user may utilize the handle 28 to provide stability to the pole 20 as the pole 20 is rotated about its longitudinal axis 26. The rotation of the pole 20 about its longitudinal axis 26 causes the first cog belt pully 40 to rotate therewith. The belt 60 transfers the rotations of the first cog belt pully 40 about the longitudinal axis 26 to the second cog belt pully 50 about the central axis 52 thereof. Rotation of the second cog belt pully 50 about the central axis 52 rotates the bulb holder 70 therewith, thereby rotating the bulb B within the light fixture F. Once the bulb B is free of the fixture F, the user moves the support structure 30 away from the fixture to ultimately lower the bulb B to the level of the user. Replacement of a bulb B into the fixture works the same way, simply with the bulb being placed within the bulb holder 70 by the user, raised to the level of the light fixture F, and aligned therewith. Then the user rotates the pole 20 to cause the rotation of the bulb holder 70. It will be understood that the pole 20 is configured to rotate clock wise and counter clock wise. The direction of rotation of the pole 20 determining the direction of rotation of the cog belt pullies 40, 50 and thus the rotation of the bulb holder 70 and ultimately the direction of rotation of the bulb B. The bulb B will either be screwed into or out of the light fixture based on the direction that the bulb holder 70 is caused to rotate based on the rotation of the pole 20.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention but is not meant to be a limitation upon the practice thereof. The following claims, including all equivalents thereof, are intended to define the scope of the invention.

The invention claimed is:

1. A light bulb changer comprising:

an elongated pole having a first end, a second end, and a longitudinal axis, the elongated pole configured to be rotated about the longitudinal axis thereof;

a support structure having a first end and a second end, the first end of the support structure engaged with the elongated pole near the second end of the elongated pole;

a first cog belt pully coupled to the elongated pole near the second end of the elongated pole, the first cog belt pulley being coaxial with the longitudinal axis of the elongated pole and configured to rotate with the elongated pole;

a second cog belt pully coupled to the second end of the support structure via a C-shaped bracket of the support structure, the second cog belt pully having a central axis that is spaced apart from the longitudinal axis of the elongated pole;

a belt spanning between the first cog belt pully and the second cog belt pully, the belt configured to cause the second cog belt pully to rotate around its central axis based on the rotation of the first cog belt pully;

a bulb holder releasably coupled to the second cog belt pully via a rod and configured to rotate therewith.

2. The light bulb changer of claim 1 wherein the elongated pole has a length that is adjustable.

3. The light bulb changer of claim 1 wherein the elongated pole has an outer diameter that is less than two inches.

4. The light bulb changer of claim 1 further comprising a handle engaged with the elongated pole near the first end of the elongated pole.

5. The light bulb changer of claim 4 wherein the elongated pole is rotatable within the handle.

6. The light bulb changer of claim 1 wherein the support structure defines a hole into which the second end of the elongated pole is inserted for rotatable engagement therewith.

7. The light bulb changer of claim 1 further comprising a collar coupled to the elongated pole near the second end of the elongated pole, the support structure configured to rest upon the collar.

8. The light bulb changer of claim 1 wherein the support structure is a housing that encloses the first cog belt pully, the second cog belt pully, and the belt.

9. The light bulb changer of claim 1 wherein the central axis of the second cog belt pully is parallel to the longitudinal axis of the elongated pole.

10. The light bulb changer of claim 1 wherein the belt is held in tension between the first cog belt pully and the second cog belt pully.

11. The light bulb changer of claim 1 wherein the bulb holder has a plurality of spring-loaded fingers biased to a closed position and movable to an open position.

12. The light bulb changer of claim 11 wherein each of the spring-loaded fingers has a friction element positioned thereon.

13. The light bulb changer of claim 1 wherein the bulb holder is configured to releasably couple to the second cog belt pully.

14. The light bulb changer of claim 1 wherein the bulb holder is configured to threadably couple to the second cog belt pully.

15. The light bulb changer of claim 1 wherein an opening of the bulb holder is configured to be positioned on a side of the support structure opposite the elongated handle.

16. The light bulb changer of claim 1 wherein an opening of the bulb holder is configured to be positioned on a side of the support structure with the elongated handle.

* * * * *